US010370905B2

(12) United States Patent
Bech et al.

(10) Patent No.: US 10,370,905 B2
(45) Date of Patent: Aug. 6, 2019

(54) MARINE FLEXIBLE ELONGATE ELEMENT AND METHOD OF INSTALLATION

(71) Applicant: CAN SYSTEMS AS, Arendal (NO)

(72) Inventors: Arild Bech, Arendal (NO); Eirik Storvoll, Arendal (NO)

(73) Assignee: CAN SYSTEMS AS, Arendal (NO)

( * ) Notice: Subject to any disclaimer, the term of this patent is extended or adjusted under 35 U.S.C. 154(b) by 0 days.

(21) Appl. No.: 16/079,036

(22) PCT Filed: Dec. 2, 2016

(86) PCT No.: PCT/NO2016/050252

§ 371 (c)(1),
(2) Date: Aug. 22, 2018

(87) PCT Pub. No.: WO2017/146584

PCT Pub. Date: Aug. 31, 2017

(65) Prior Publication Data

US 2019/0048668 A1 Feb. 14, 2019

(30) Foreign Application Priority Data

Feb. 23, 2016 (NO) ..... 20160308

(51) Int. Cl.
*E21B 17/01* (2006.01)
*B63B 21/20* (2006.01)
*B63B 21/50* (2006.01)

(52) U.S. Cl.
CPC ..... *E21B 17/015* (2013.01); *B63B 21/20* (2013.01); *B63B 21/50* (2013.01); *E21B 17/012* (2013.01); *B63B 2021/203* (2013.01)

(58) Field of Classification Search
CPC combination set(s) only.
See application file for complete search history.

(56) References Cited

U.S. PATENT DOCUMENTS 4,279,543 A 7/1981 Remery
5,159,891 A * 11/1992 Lohr ..... B63B 21/20 114/230.2

(Continued)

FOREIGN PATENT DOCUMENTS

EP 0729882 A1 9/1996
WO WO 9966169 A2 12/1999

OTHER PUBLICATIONS

Norwegian Search Report issued in Norwegian Patent Application No. 20160308 dated Aug. 26, 2016.

(Continued)

*Primary Examiner* — Kyle Armstrong
(74) *Attorney, Agent, or Firm* — Arent Fox LLP

(57) ABSTRACT

A flexible elongate element for installation in a body of water to extend between a seabed connection device and a unit arranged at the opposite end of the flexible elongate element. At least one lateral displacement device is connected to a portion of the flexible elongate element and configured to displace at least a portion of the flexible elongate element a lateral distance away from a first axis extending between the seabed connection device and the unit, the at least one lateral displacement device including a spring member. The flexible elongate element may be a flexible riser, umbilical, hose, or cable.

17 Claims, 4 Drawing Sheets

(56) References Cited

U.S. PATENT DOCUMENTS

| | | | | |
|---|---|---|---|---|
| 5,884,576 | A * | 3/1999 | Wajnikonis | B63B 21/50 114/230.2 |
| 6,558,215 | B1 | 5/2003 | Boatman | |
| 7,287,936 | B2 | 10/2007 | Streiff et al. | |
| 9,151,121 | B2 * | 10/2015 | Tan | E21B 17/012 |
| 2004/0163817 | A1 | 8/2004 | Horton, III | |
| 2009/0269141 | A1 * | 10/2009 | Li | B63B 27/24 405/169 |
| 2009/0293792 | A1 | 12/2009 | Alliot | |
| 2011/0155383 | A1 | 6/2011 | Christiansen et al. | |
| 2013/0292129 | A1 * | 11/2013 | Tan | E21B 17/012 166/350 |
| 2016/0053919 | A1 * | 2/2016 | Zhimin | E21B 17/015 405/171 |
| 2016/0168921 | A1 * | 6/2016 | Tan | E21B 17/015 166/350 |
| 2016/0258553 | A1 * | 9/2016 | Zhang | F16L 1/24 |

OTHER PUBLICATIONS

Norwegian Search Report issued in Norwegian Patent Application No. 20161925 dated Oct. 12, 2017.

International Search Report issued in International Patent Application No. PCT/NO2016/050252 dated Feb. 23, 2017.

* cited by examiner

MARINE FLEXIBLE ELONGATE ELEMENT AND METHOD OF INSTALLATION

CROSS-REFERENCE TO RELATED APPLICATION

This application is a 35 U.S.C. 371 National Phase of PCT Application No. PCT/NO2016/050252 filed Dec. 2, 2016 which claims priority to NO Application No. 20160308 filed Feb. 23, 2016. The disclosure of these prior applications are hereby incorporated by reference herein.

FIELD OF THE INVENTION

The invention concerns marine flexible elongate elements, such as cables, umbilicals, flexible risers, or similar, that are configured for connection between a structure and a seabed installation. More specifically, the invention concerns a flexible elongate element as set out by the preamble of claim 1, and a method of installation, as set out by the preamble of claim 15.

BACKGROUND OF THE INVENTION

Marine risers are integral part of drilling and production activity of oil and gas exploration. They provide means for drill strings and production tubing to reach the oil well deep down at the ocean floor. Several buoyant structures (e.g. platforms, ships) are often used to support oil and gas processing equipment, storage facilities or other facilities where fluids which are being transferred between the seabed and the buoyant structure. Marine risers comprise sections of pipes sometimes called "conductors" or "casings" connected together as a "string" of "risers" and the vessels are suitably outfitted "ships" or "semi-submersibles", also referred to as "rigs".

In shallow water (e.g. less than 100 meters), different types of risers are available for FPSO (Floating Production, Storage and Offloading) vessels that have been developed for operations in shallow water. One such riser type comprise unbonded steel flexible pipe, having steel layers wound around an inner carcass, covered with a plastic sheathing. Such flexible risers are important components for offshore developments because they can accommodate the large motions induced by floating structures and can also resist hydrodynamic loadings such as waves and currents. The flexible risers have high axial stiffness and low bending stiffness. These properties increase the ability of the flexible riser to handle large deformations. These large deformations may be generated by ocean currents and/or waves, or by the motions of the floating structure. Other types of flexible risers are bonded pipes (hoses) and composite pipes.

One of the main characteristics of riser systems in shallow water is the large degree of compliancy required to accommodate the relatively large vessel offsets compared to water depth. Several attempts have been made in order to develop riser configure that offer a large degree of compliancy.

A variety of configurations are used when suspending the riser between the floating structure and the seabed. A considerable part of a flexible riser system is the determination of the configuration so that the riser can safely sustain the extreme seastates loading. In general, the critical sections in the riser configurations are at the ends (top or bottom), where there are high tensile forces and large curvatures. They are also critical at the sag bend, where there is large curvature (at low tension), and at the hog of a wave buoyancy section, where there is large curvature (at low tension). The standard riser configurations generally used in the industry are "free-hanging catenary", "lazy-S", "Lazy wave", "Steep-S", "compliant wave" and "steep wave". These different riser configurations are obtained by use of various configurations of buoyancy elements, weight elements and tether lines that are fixed to the riser and sometimes anchored to the seabed.

Traditional riser systems for shallow water are very little offset-friendly, leading to strict offset tolerances and heavy mooring systems. Normally, the traditional riser systems have a so-called two-dimensional (2D) wave configuration where buoyancy modules, acting as springs, bring the riser to a wave configuration in the vertical (x-z) plane. This riser configuration is not suitable for shallow water, especially not for waters shallower than 40 meters. In these environments, the riser may be subject to excessive bending, overstretching and interference with the floating structure, mooring devices, buoyancy devices, and the seabed.

The prior art includes EP 0 729 882 A1, which describes a seabed flowline connected to a conventional tanker serving as a floating storage facility by a system comprising a three-leg mooring and a flexible riser. The mooring comprises anchors connected by anchor lines to a common node, and a mooring pendant extending from the node to the tanker. The flexible riser comprises a flexible rubber hose extending from the seabed to the tanker, the hose having a top section secured along part of the mooring pendant, and an intermediate section provided with buoyancy members and restrained by a tether to maintain it clear of the anchor risers and the mooring node.

The prior art includes U.S. Pat. No. 7,287,936 B2, which describes a shallow water riser for extending beneath a sea and above a seabed between a connection at the seabed and a connection to a floating support, the shallow water riser having a wave form between the seabed connection and the floating support connection, which is shaped, is of such length and is positioned to include at least two riser wave parts in succession. Each of the two riser wave parts including a respective lower wave part toward the seabed, followed by a crest away from the seabed, one of the crests being between the two lower wave parts, at least one of the lower wave parts being positioned to be in contact with the seabed and the shallow water riser being of such length to enable such contacts and crests. This system utilizes a 2D wave configuration.

The prior art also includes US 2011/0155383 A1, discloses a transfer system for transferring hydrocarbons, power or electrical/optical signals to/from the seabed to the vessel or other buoyant structure in the shallow water when exposed to the environmental loadings from wind, wave and current. The conduit transfer system comprising a flexible pipe or umbilical extending from the buoyant unit at one end and to the seabed at the other end; and a riser support fixed to the seabed for supporting the flexible pipe characterized in that the flexible pipe a plurality of buoyancy beads for creating one or more inverse catenary curves of the flexible pipe to provide an excursion envelope. The system utilizes a 2D wave configuration.

The prior art also includes US2004/0163817 A1, describes a riser system that compensates for the motions of an associated floating platform comprises a vertical pipe section supported by the floating vessel and extending downward from the vessel substantially perpendicular to the sea floor, and a horizontal pipe section connected to the associated sub-sea well equipment and extending away from the equipment substantially parallel to the sea floor. An angled elbow pipe connects the horizontal pipe to the vertical pipe. At least one of the horizontal and the vertical pipes incorporates a flexing portion comprising a plurality of recurvate sections of pipe connected end-to-end with alternating curvatures. In one embodiment, the central axis of the flexing portion lies in a single plane and takes a sinusoid path. In another embodiment, the central axis of the flexing portion takes a three dimensional helical path. This system is not suitable for a flexible riser system.

It is therefore a need for a configuration for a flexible riser or a cable in which the riser or cable is not subject to excessive bending, overstretching and interference with mooring or buoyancy devices, particularly in shallow water.

SUMMARY OF THE INVENTION

The invention is set forth and characterized in the main claims, while the dependent claims describe other characteristics of the invention.

It is thus provided a flexible elongate element for installation in a body of water and configured for extending between a seabed connection device and a unit arranged at the opposite end of the flexible elongate element; characterized by at least one lateral displacement device connected to a portion of the flexible elongate element and configured to displace at least a portion of the flexible elongate element a lateral distance away from an imaginary axis extending between the seabed connection device and the unit, said at least one lateral displacement device comprising spring means.

In one embodiment, the flexible elongate element further comprises at least two lateral displacement devices, each lateral displacement device connected to a respective portion of the flexible elongate element and configured to displace at least a portion of the flexible elongate element a lateral distance away from an imaginary axis extending between the seabed connection device and the unit. The lateral displacement devices may be configured to act in generally opposite directions.

The lateral displacement device may further be configured to displace at least a portion of the flexible elongate element a vertical distance below the water surface.

In one embodiment, the lateral displacement device comprises a seabed anchor means. The flexible elongate element may comprise one or more support members whereby at least a portion of the flexible elongate element is suspended above the seabed. The support members may comprise one or more buoyancy members.

In one embodiment, the lateral displacement device comprises tethers connected between the flexible elongate element and the seabed anchor means via the spring means, and the spring means comprise a buoy and a clump weight.

The unit may be a plug, or a vessel floating in the water.

In one embodiment, at least a portion of the flexible elongate element is configured to curve a lateral distance.

The flexible elongate element may be a flexible riser, a cable, an umbilical, or a hose. The spring means may comprise any spring device which is dimensioned to provide a desired restoring force. The flexible elongate element may comprise damper means configured to interact with the spring means. The damper means may comprise water in the body of water (W), interacting with the spring means.

It is also provided a method of installing a flexible elongate element in a body of water, wherein a first flexible elongate element end is connected to a seabed connection device and second flexible elongate element end is connected to a unit; characterized by connecting at least one lateral displacement device comprising spring means to a portion of the flexible elongate element and operating said device to displace at least a portion of the flexible elongate element a lateral distance away from an imaginary axis extending between the seabed connection device and the unit.

In one embodiment, the method comprises connecting at least two lateral displacement devices to respective portions of the flexible elongate element and operating said devices to displace at least a respective portion of the flexible elongate element a lateral distance in generally opposite directions, away from an imaginary axis extending between the seabed connection device and the unit. In one embodiment, said device is operated to displace at least a portion of the flexible elongate element a vertical distance below the water surface.

The operation may comprise the connection of a tether system between the flexible elongate element and a seabed anchor means.

In one embodiment of the method, the flexible elongate element comprises one of more support members, for example in the form of buoyancy members, whereby at least a portion of the flexible elongate element is suspended above the seabed. The unit may be a plug, or a vessel floating in the water. The spring means may comprise combinations of buoy(s) and clump weight(s).

The basis for the invented 3D flexible elongate element (e.g. riser) configuration may for example be a long wave configuration. The long wave configuration itself does not provide sufficient flexibility to allow a sensible mooring design in shallow water, especially taking into consideration line-break cases. In the case of a flexible riser, the limitations are full stretch of the riser in far direction and touching the vessel bottom and seabed in near directions when the top end moves around. When water depth is 30 meter or below, it is extremely challenging to configure the flexible riser with an offset of ±10 meters. In order to configure a flexible riser with at least ±10 meter offset, one may need a lot of anchoring to make the system much stiffer, and this may damage the riser. The invention comprises the formation of a lateral curve or wave into the long wave configuration, thus forming a 3D wave configuration which can take literally any offset of the top end. This configuration will allow a sufficient offset even in the shallowest of water (e.g. 30 meters deep). This 3D wave configuration is achieved by the lateral displacement devices, attached to the flexible riser and thus acting as sideways (lateral) springs. The displacement devices (e.g. tether system) also control the vertical position of the flexible elongate element (riser, umbilical, cable, etc.) in the water column. This may allow for variations in the density of the internal product over time which may be a challenge for shallow water riser configurations in combination with maintaining offset flexibility. The configuration is also stable in high sea currents and allows for piggyback of umbilicals, multiple riser and cable configurations, etc.

The invented 3D wave configuration (i.e. the displacement devices) is easy to install and may relax tight installation tolerances. The flexible elongate element is installed at lower and upper end in a traditional way and the flexible elongate element will float high in the water (may be at surface). The preinstalled lateral tether anchor points are thereafter connected to the preinstalled connections to the element (bridles). This can be done on the surface (i.e. above water) in air by interconnecting the two tether ends. With at least one tether system connected, the flexible elongate element obtains its 3D configuration.

The invention is particularly useful for operations in shallow water (e.g. in water depths less than 100 meters, and allows for a larger of offset than the prior art systems. The invention is useful for all types of flexible elongate elements, such as flexible risers (e.g. unbonded steel flexible pipe, bonded pipes (hoses) and composite pipes), as well as cables and umbilicals.

With the invention, it is possible to use lighter cables, risers (having e.g. composite pipes) and umbilicals, and still maintain a stable configuration, because the lateral displacement devices provide enhanced vertical control.

BRIEF DESCRIPTION OF THE DRAWINGS

These and other characteristics of the invention will become clear from the following description of an embodiment, given as a non-restrictive example, with reference to the attached schematic drawings, wherein.

DETAILED DESCRIPTION OF AN EMBODIMENT

Figure 1:
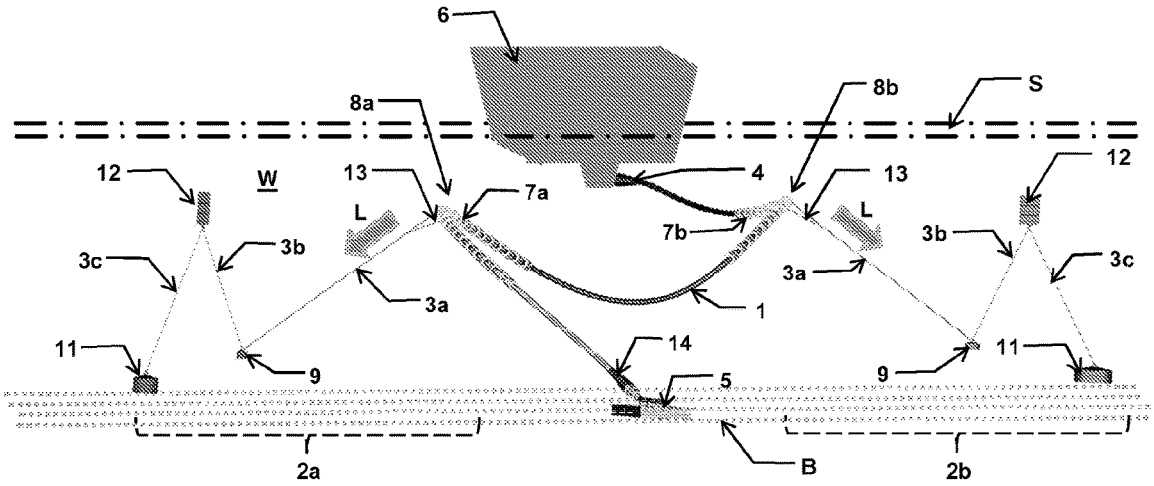
FIG. 1 is a schematic view along an imaginary x-axis of an embodiment of the invented flexible elongate element, installed between a seabed base and a floating vessel.

The following description may use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the invention. The terms are used for the reader's convenience only and shall not be limiting.

FIG. 1 is an illustration of an embodiment of the invented flexible elongate element configuration in a body of water W, between a water surface S and a seabed B. In the following description, the flexible elongate element will be referred to as a flexible riser.

A flexible riser 1 comprises a plurality of buoyancy members 7*a*, 7*b*, generally arranged in two groups in order to provide a wave configuration. Such buoyancy members, and their application on and connection to flexible risers, are well known and need therefore not be described in more detain here. The flexible riser 1 may also be inherently buoyant. The flexible riser may be any known flexible riser, umbilical or cable type known in the art, for example—but not necessarily limited to—for transmitting power, electrical/optical signals, and/or fluids between the seabed and a topsides vessel. The term "flexible riser" shall therefore not be limiting, but encompass other elongate flexible elements as well. The riser comprises a seabed connector 14, by means of which the riser is connected to a riser base 5, for example a PLEM (pipeline end manifold). The riser base 5 may for example be a gravity structure, a piled structure, or a suction/anchor pad. The other end of the flexible riser comprises topsides connector 4, which is connected to a floating vessel 6, for example an FPSO (floating production, storing and offloading) vessel. The topsides connector 4 typically comprises a bend stiffener and may for example be connected to the vessel 6 via turret. The various means and devices for connecting the flexible riser 1 to the riser base 5 and to the vessel 6 are well known in the art and need therefore not be described in more detail here. The invention shall not, however, be limited to connection to a floating vessel.

Connected to the flexible riser 1 are two lateral tether systems 2*a*, 2*b* (in the following also referred to as lateral displacement devices). In the illustrated embodiment, each tether system 2*a*, 2*b* comprises a tether 3*a-c* connected between respective portions 8*a,b* on the riser and respective tether anchors 11 on the seabed B. The anchors 11 may for example be a gravity-based anchor, a piled anchor, or a suction anchor. Each tether comprises a first portion 3*a*, which is connected between its respective portion 8*a,b* (via e.g. a bridle connection 13) and a clump weight 9. A second tether portion 3*b* is connected between the clump weight 9 and a buoy 12, and a third tether portion 3*c* is connected between the buoy 12 and the tether anchor 11 on the seabed. The tether material is of a kind which per se is known in the art (e.g. polyester). In FIG. 1, the buoys 12 are shown as being submerged in the water W, i.e. below the surface S. It should be understood, however, that the illustration in FIG. 1 may show only a transient state. The skilled person will understand that whether the buoys are submerged or floating is in fact determined by the buoyancy generated by the buoys and the overall forces acting on the system (i.e. riser, vessel, and tether systems). These forces may vary considerably, depending on water currents waves, etc. The combination of the buoy 12, clump weight 9 and the connection to the respective riser portion 8*a,b*, provides an effective spring, and—due to resistance provided by the water when the parts are moving—serves to dampen the riser movements. It should therefore be understood that the buoy and clump weight may be substituted by other spring and damper means. The spring means may be dimensioned to provide the desired restoring force (i.e. spring constant). In the illustrated embodiment, this spring constant may be designed by an appropriate dimensioning of the mass of the clump weight 9 and the buoyancy of the buoy 12.

The tether systems 2*a*, 2*b* thus act as lateral displacement devices, serving to pull its respective riser portion 8*a*, 8*b* sideways (i.e. laterally), indicated by the force arrows "L" in FIG. 1, away from the (imaginary) line between the riser base 5 and the floating vessel 6. The lateral tether systems thus generate a riser in a "three-dimensional (3D) wave"), in that the flexible riser exhibits a sideways wave, in addition to the more or less vertical (2D; prior art) wave. The lateral displacement devices may be applied to any known 2D wave configuration (e.g. lazy wave, steep wave, pliant wave) and generate augmented, 3D, riser configurations, that are particularly useful in shallow water.

Figure 2:
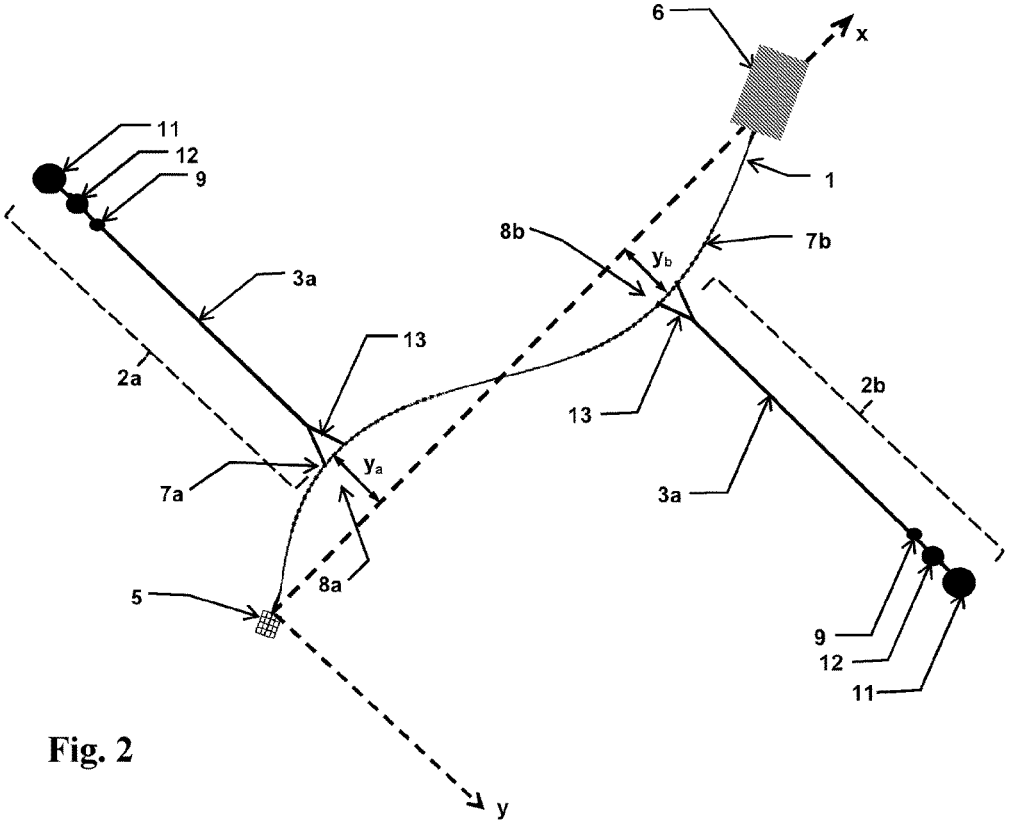
FIG. 2 is plan view of the embodiment shown in FIG. 1.
Figure 3:
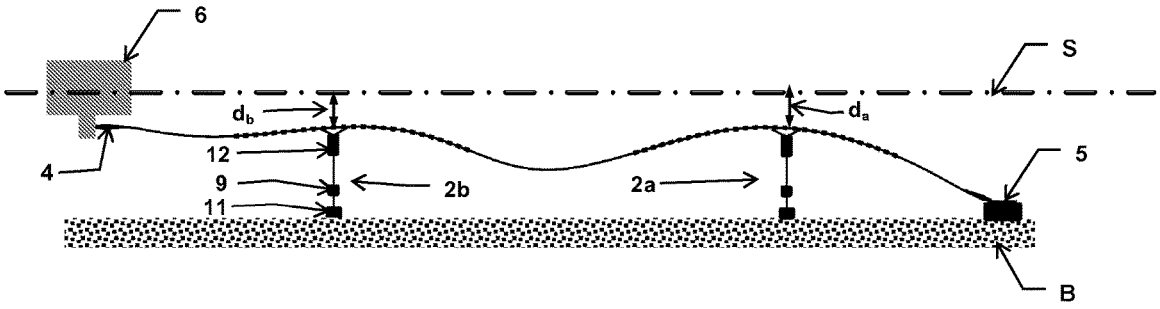
FIG. 3 is a side view of the embodiment illustrated in FIG. 1 and FIG. 2.

The invented riser configuration is further illustrated in FIGS. 2 and 3. The first tether system 2*a* (comprising the 3*a-c*, clump weight 9, buoy 12 and anchor 11) serves as a displacement device to pull a first portion 8*a* of the flexible riser 1 a lateral distance $y_a$ away from the x-axis extending between the riser base 5 and the vessel 6, and a vertical distance $d_a$ below the water surface S. Similarly, the second tether system 2*b* (comprising a tether 3*a-c*, clump weight 9, buoy 12 and anchor 11) serves as a displacement device to pull a second portion 8*b* of the flexible riser 1 a lateral distance $y_b$ away from the x-axis, and a vertical distance $d_b$ below the water surface. It should be understood that these distances are not necessarily constant values, as the flexible riser is a prone to move in the water when subjected to waves, currents and varying loading. Thus, the lateral displacement devices (e.g. tether system) may also in fact control the vertical position (cf. $d_a$, $d_b$) of the riser in the water column. This may allow for variations in the density of the internal product over time which may be a challenge for shallow water riser configurations in combination with maintaining offset flexibility. The configuration also allows for piggyback of umbilicals, multiple riser configurations etc.

Figure 4A:
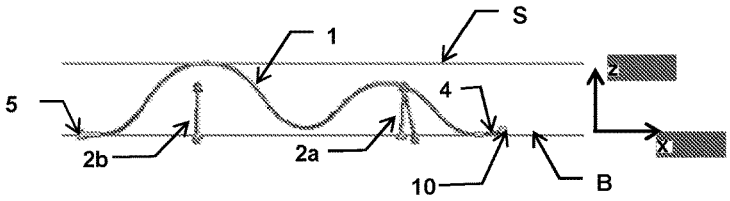
FIGS. 4*a* and 4*b* are a schematic side view and plan view, respectively, of a flexible elongate element installed between a base and a plug, prior to connection of lateral displacement devices.
Figure 4B:
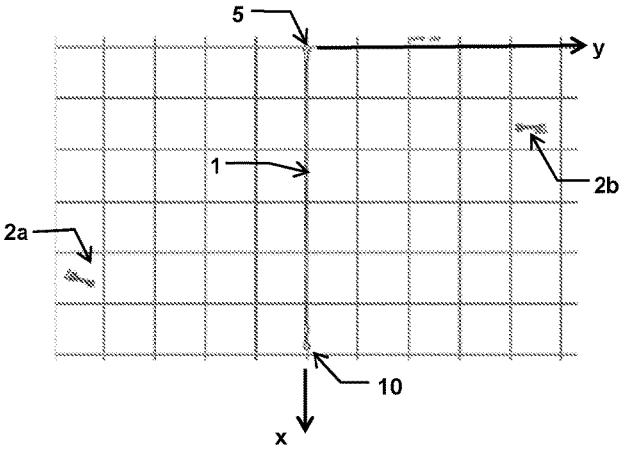

FIGS. 4*a* to 6*b* illustrate a typical installation sequence for the invented riser configuration:

FIG. 4*a* and FIG. 4*b* (side view and plan view, respectively):

The flexible riser 1 has been connected to the riser base 5 at one end and to a plug 10 (via the topsides connector 4) at the other end.

The riser generally exhibits a long wave in the water, by virtue of its buoyancy members 7*a,b* (see FIG. 1, not shown in FIGS. 4*a*, 4*b*).

Lateral displacement devices (i.e. tether systems, as described above) 2*a*, 2*b* have been installed on seabed but not connected to riser.

Figure 5A:
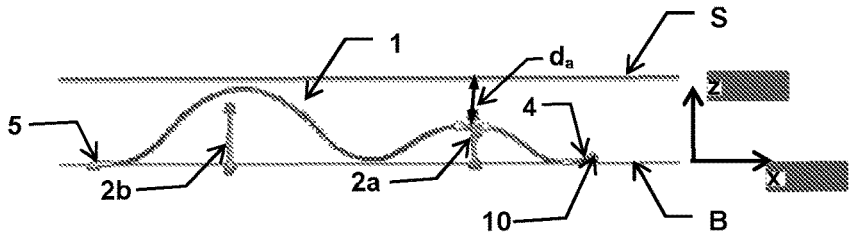
FIGS. 5*a* and 5*b* are a schematic side view and plan view, respectively, of a flexible elongate element installed between a base and a plug, with a first lateral displacement device connected to the elongate element, causing a first lateral displacement.
Figure 5B:
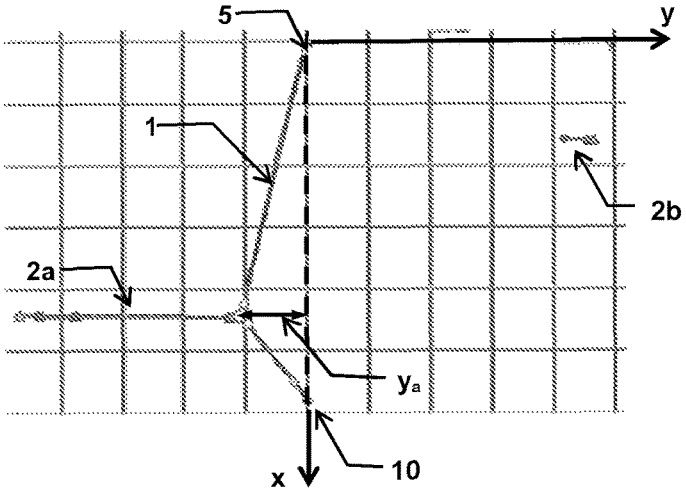

FIG. 5*a* and FIG. 5*b* (side view and plan view, respectively):

The first tether system 2*a* has been connected to a first portion of the flexible riser, displacing a portion of the riser a lateral distance $y_a$ with respect to the x-axis and a vertical distance $d_a$ below the water surface S.

Figure 6A:
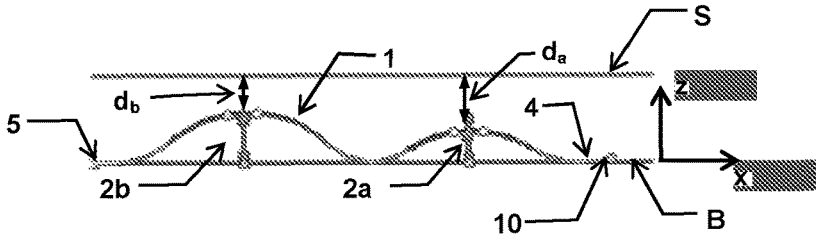
FIGS. 6*a* and 6*b* are a schematic side view and plan view, respectively, of a flexible elongate element installed between a base and a plug, with a first lateral displacement device connected to a first part of the elongate element, causing a first lateral displacement, and a second lateral displacement device connected to a second part of the elongate element, causing a second lateral displacement.
Figure 6B:
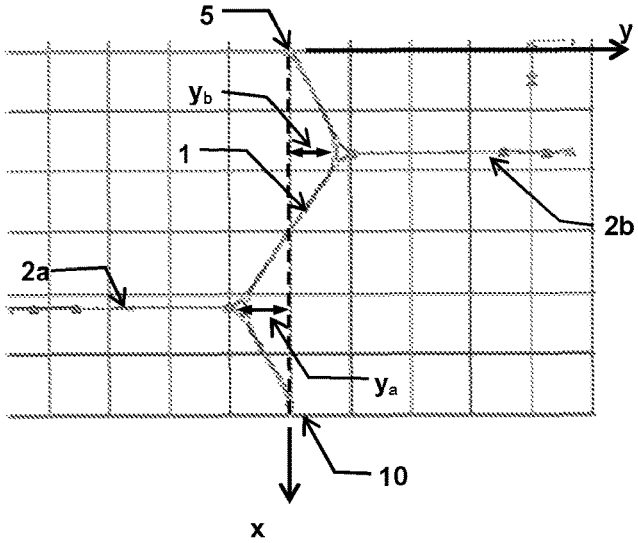

FIG. 6*a* and FIG. 6*b* (side view and plan view, respectively):

The second tether system $\mathbf{2}_b$ has been connected to a second portion of the flexible riser, displacing a portion of the riser a lateral distance $y_b$ with respect to the x-axis and a vertical distance $d_b$ below the water surface S.

Upon completion of the operations illustrated in FIGS. 6*a* and 6*b*, the topsides connector 4 and the plug 10 may be retrieved and connected to a vessel (in a manner well known in the art), resulting in a configuration similar to those illustrated by FIGS. 1, 2, 3.

Figure 7:
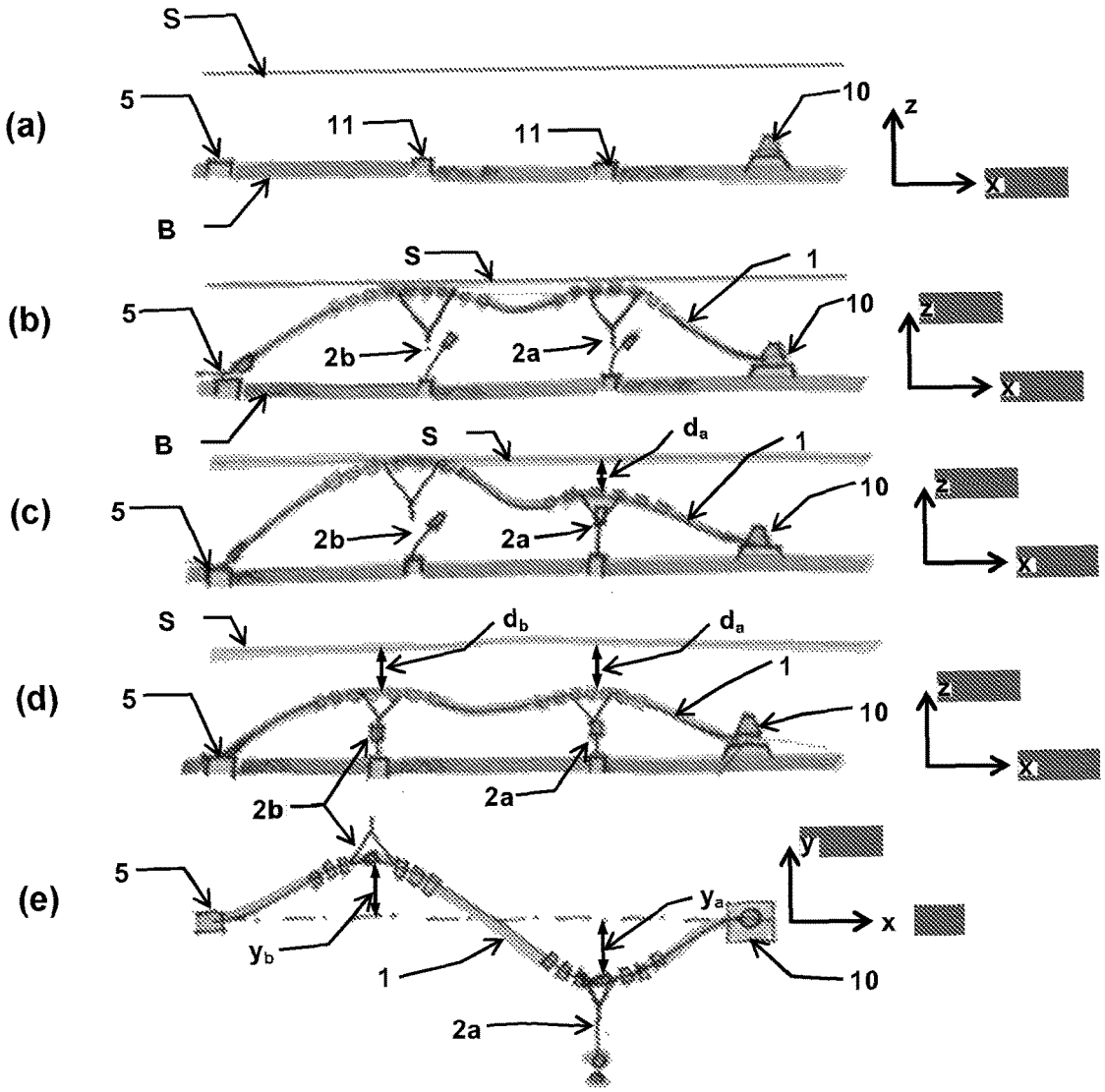
FIGS. 7*a* to 7*d* are schematic side views illustrating an installation sequence for a flexible elongate element.
FIG. 7*e* is a plan view of FIG. 7*d*.

FIG. 7 illustrates a similar installation sequence to that described above with reference to FIGS. 4*a* to 6*b*. In FIG. 7, drawing (a) shows the preinstalled plug 10, riser base 5 and two tether anchors 11. In drawing (b), both tether systems 2*a*, 2*b* have been connected to its respective anchor 11 but have not been attached to the flexible riser. In drawing (c), the first tether system 2*a* has been connected to a first portion of the riser. In drawing (d), the second tether system 2*b* has been connected to a second portion of the riser, thus completing the riser installation. Drawing (e) is a plan (top) view of drawing (d).

Although the figures indicate that the tethers are connected to the flexible riser below water, it should be understood that the tethers may be connected to the riser while the riser is floating in the water surface S, or be preinstalled prior to riser installation. The installation of tether anchors, and connected of the tethers to the riser and to the seabed anchors, may be performed by known methods and equipment.

Although the invention has been described with two lateral tether systems, it should be understood that other numbers are possible. For example, using only one tether system, the resulting wave configuration will be as illustrated in FIGS. 5*a* and 5*b*.

Although the invention has been described with reference to a flexible riser, it should be understood that the invention is equally applicable to other flexible, elongate, elements installed in a body of water. Examples of such elements are hoses, umbilicals, and cables. The cables may for example be telecommunications cables or power cables, and comprise metal conductors or fiber optic conductors.

Although the invention has been described with reference to tethers, it should be understood that other lateral displacement systems are possible and conceivable.

The invention claimed is:

1. A flexible elongate element installed in a body of water and extending between a seabed connection device and a first unit arranged at a first end of the flexible elongate element; the flexible elongate element being capable of a wave configuration in a vertical direction via at least one of a plurality of buoyancy members or inherent buoyancy of the flexible elongate element wherein at least a first_lateral displacement device is connected to a first portion of the flexible elongate element and configured to displace at least a portion of the flexible elongate element a lateral distance away from a first axis extending between the seabed connection device and the first unit such that the flexible elongate element exhibits a sideways wave in addition to a vertical wave, the at least a first lateral displacement device comprising a_spring and damper member, wherein the flexible elongate element further comprises at least a second lateral displacement device, wherein at least the first and second lateral displacement devices are connected to the first portion and a second portion of the flexible elongate element, respectively, and are configured to displace at least a portion of the flexible elongate element the lateral distance away from the first axis, wherein the first and second portions are offset longitudinally along the first axis.

2. The flexible elongate element of claim 1, wherein the at least a first and second lateral displacement devices are configured to act in generally opposite directions.

3. The flexible elongate element of claim 1, wherein the at least a first lateral displacement device is further configured to displace at least a portion of the flexible elongate element a vertical distance below the surface of the body of water.

4. The flexible elongate element of claim 1, wherein the at least a first lateral displacement device further comprises a seabed anchor portion.

5. The flexible elongate element of claim 1, wherein the flexible elongate element further comprises at least one support member, wherein at least a portion of the flexible elongate element is suspended above the seabed.

6. The flexible elongate element of claim 5, wherein the at least one support member further comprises at least one buoyancy member.

7. The flexible elongate element of claim 1, wherein the at least a first lateral displacement device comprises tethers connecting the flexible elongate element and a seabed anchor portion via the spring and damper member, and the spring and damper member further comprise:

a buoy submerged or floating in the body of water; and
a clump weight.

8. The flexible elongate element of claim 1, wherein the first unit is a plug, or a vessel floating in the body of water.

9. The flexible elongate element of claim 1, wherein at least a portion of the flexible elongate element is configured to curve the lateral distance.

10. The flexible elongate element of claim 1, wherein the flexible elongate element is a flexible riser, a cable, an umbilical, or a hose.

11. The flexible elongate element of claim 1, wherein the spring and damper member comprises a spring and damper device dimensioned to provide a desired restoring force.

12. A method of installing a flexible elongate element in a body of water, wherein a first flexible elongate element end is connected to a seabed connection device and second flexible elongate element end is connected to a first unit the flexible elongate element comprising buoyancy members or inherent buoyancy to provide a wave configuration in a verical vertical direction; the method further comprising: connecting at least one first lateral displacement device comprising a spring and damper member to a first portion of the flexible elongate element and operating the at_least one first lateral displacement device to displace at least a portion of the flexible elongate element a lateral distance away from a first axis extending between the seabed connection device and the first unit such that the flexible elongate element exhibits a sideways wave in addition to a vertical wave, wherein the method further comprises:

connecting at least the first lateral displacement device and a second lateral displacement device to a first and second portion of the flexible elongate element so that the first and second portions are offset longitudinally along the first axis; and operating the at least the first and second lateral displacement devices to displace at least a respective portion of the flexible elongate element the lateral distance in generally opposite directions, away from the first axis.

13. The method of claim 12, wherein the device is operated to displace at least a portion of the flexible elongate element a vertical distance below the surface of the body of water.

14. The method of claim 12, wherein the method further comprises the connection of a tether system between the flexible elongate element and a seabed anchor portion.

15. The method of claim 12, wherein the flexible elongate element comprises at least one support member, wherein the at least one support member is a buoyancy member, wherein at least a portion of the flexible elongate element is suspended above the seabed.

16. The method of claim 12, wherein the first unit is a plug, or a vessel floating in the body of water.

17. The method of claim 12, wherein the spring and damper member further comprise:

a buoy submerged or floating in the body of water; and
a clump weight.

* * * * *